US005549257A

United States Patent [19]

Sanda et al.

[11] Patent Number: 5,549,257

[45] Date of Patent: Aug. 27, 1996

[54] METAL WIRE WINDING REEL

[75] Inventors: Kenji Sanda; Hitoshi Inoue, both of Ono, Japan

[73] Assignee: Tokusen Kogyo Co., Ltd., Hyogo, Japan

[21] Appl. No.: 333,781

[22] Filed: Nov. 3, 1994

[30] Foreign Application Priority Data

Nov. 12, 1993 [JP] Japan ..... 5-060970 U
May 18, 1994 [JP] Japan ..... 6-005392 U

[51] Int. Cl.[6] ..... B65H 75/28

[52] U.S. Cl. ..... 242/580; 242/125.2

[58] Field of Search ..... 242/125.2, 125.3, 242/580, 586, 587, 587.1, 587.2, 587.3, 614, 586.4, 586.6

[56] References Cited

U.S. PATENT DOCUMENTS

| | | | |
|---|---|---|---|
| 766,936 | 8/1904 | DeRoseau | 242/125.2 |
| 939,734 | 11/1909 | Müller | 242/125.2 |
| 1,408,261 | 2/1922 | Brookhart | 242/125.2 |
| 1,681,263 | 8/1928 | Smith | 242/125.2 |
| 1,926,539 | 9/1933 | Hurst | 242/125.2 |
| 2,374,111 | 4/1945 | Le Tourneau | 242/587 |
| 2,662,701 | 12/1953 | Weber | 242/614 |
| 2,930,537 | 3/1960 | Davis et al. | 242/125.2 |
| 3,032,292 | 5/1962 | Levinson | 242/125.2 |
| 3,481,557 | 12/1969 | Miller | 242/580 |
| 3,758,045 | 9/1973 | Allen | 242/125.2 |
| 4,168,811 | 9/1979 | Lewis | 242/614 |
| 4,317,548 | 3/1982 | Rottleb | 242/125.2 |
| 4,603,820 | 8/1986 | Olofsson | 242/125.2 |
| 4,707,891 | 11/1987 | Chidester | 242/125.3 |
| 4,880,182 | 11/1989 | Gelfman | 242/580 |
| 4,913,369 | 4/1990 | Lia et al. | 242/580 |

FOREIGN PATENT DOCUMENTS

| | | | |
|---|---|---|---|
| 510857 | 12/1920 | France | 242/125.2 |
| 875573 | 5/1953 | Germany | 242/125.2 |
| 4021744 | 1/1992 | Germany | 242/586.4 |
| 59-7331 | 6/1984 | Japan . | |

*Primary Examiner*—John P. Darling
*Attorney, Agent, or Firm*—Marshall, O'Toole, Gerstein, Murray & Borun

[57] ABSTRACT

A metal wire winding reel having a winding drum and a flange at each end is capable of engaging and releasing the metal wire end easily without shortening the reel life. An elastic end engaging member with the forward end thereof slightly bent outward along an outer peripheral edge of the flange defines a small clearance with the outer peripheral edge of the flange is mounted at least at one point in the vicinity of the outer periphery of the inside surface of the flange.

7 Claims, 9 Drawing Sheets

METAL WIRE WINDING REEL

The present invention relates to a reel for winding a metal wire including a steel wire, a steel cord, a wire rope or an electric wire.

BACKGROUND OF THE INVENTION

A conventional structure for taking up a metal wire on a reel and fixing the end of the metal wire when wound up full, as shown in FIG. 15, generally comprises a small hole 22 formed in the outer periphery of a flange 21 and an engaging member 23 of a steel wire or a spring plate on the outside surface of the flange 21 in the vicinity of the small hole 22. The metal wire end Wo led out of the small hole 22 is held between the engaging member 23 and the outside surface of the flange 21.

In another fixing structure disclosed by Japanese Utility Model Publication No. 59-7331, as shown in FIG. 16, a notch 32 is formed in an outer peripheral edge 31*a* of a flange, and an engaging member 33 is installed on the outside surface of the flange 31 in proximity to the notch 32, so that the metal wire end Wo is passed through the notch 32 and held between the engaging member 33 and the outside surface of the flange 31.

In the conventional structure of FIG. 15 for winding wire on a reel, it takes time to pass the metal wire end Wo through the small hole 22, and it also is troublesome and time consuming to be required to remove the end Wo at the time of wire release. Also, in the case where the metal wire is a twisted wire of many strands such as steel cord or wire rope, the end Wo of strands becomes loose, making it difficult to pass the wire through the small hole 22. It therefore becomes necessary to wind the end Wo with tape or to fuse the strands together by welding in advance, thereby requiring a very troublesome and time consuming wire winding procedure.

In a rubber coating or calendering process for tires, which is one of the intermediate processes for tire production, steel cords are normally supplied from more than 500 reels. In the tire production process, the procedure for releasing the end of the steel cord from an engaging member on all the reels is performed at the same time. The time to be spent for the wire release procedure is required to be only a few seconds. The disadvantage of the conventional structure of FIG. 15 is the considerable trouble and time required to be taken for wire release.

In the structure of FIG. 16, on the other hand, the task of passing the metal wire end Wo through a small hole is eliminated, and therefore the working efficiency is improved. The notch 32, however, considerably reduces the flange strength of the particular portion, with the result that the side pressure generated when winding the metal wire on the reel distorts the flange. Consequently, the winding form of the wire is deformed or the service life of the reel is shortened.

It is therefore desired to provide a metal wire winding reel in which the end of the metal wire can be easily engaged and released from the winding reel without shortening the reel life.

SUMMARY OF THE INVENTION

According to the first aspect of the invention, there is provided a metal wire winding reel with a flange at each end of a winding drum, characterized in that an elastic end engaging member has a forward end thereof slightly bent outward along the outer peripheral edge of the flange, and defines a small clearance with the outer peripheral edge of the flange is mounted at least at one point in the vicinity of the outer periphery of the flange.

According to the second aspect of the invention, there is provided a metal wire winding reel including a flange at each end of a winding drum, characterized in that an elastic end engaging member having a forward end defines a small clearance with the flange and is mounted in at least one recess formed in the vicinity of the outer periphery of the inside surface of the flange.

According to the third aspect of the invention, there is provided a metal wire winding reel including a flange at each end of a winding drum, characterized in that an end engaging member of a metal elastic member is installed in such a manner as to be fitted in a recess formed at least at one point on the inside surface of the flange and extending in a radial direction to the outer peripheral edge of the flange, the end engaging member has a forward end thereof slightly bent outward along the outer peripheral edge of the flange and defines a small clearance with the outer peripheral edge of the flange. The end engaging member has a base thereof fixed on the flange.

According to the fourth aspect of the invention, there is provided a metal wire winding reel characterized in that the metal elastic member is a flat metal plate.

According to the fifth aspect of the invention, there is provided a metal wire winding reel including a flange at each end of a winding drum, characterized in that an end engaging member of a flat metal plate is installed at least at one point on the inside surface of the flange in such a manner as to be fitted in a recess extending in radial direction to the outer peripheral edge of the flange. The end engaging member has a part of the flat metal plate bent to form double metal plates, and a base mounted on the flange. The end engaging member includes a forward end thereof slightly bent outward along the outer periphery edge of the flange, and defines a clearance extending from the forward end of the end engaging member to the base between the end engaging member and the inside surface of the flange.

According to the sixth aspect of the invention, there is provided a metal wire winding reel including a flange at each end of a winding drum, characterized in that an end engaging member of a flat metal plate is installed at least at one point on the inside surface of the flange in such a manner as to be fitted in a recess extending in radial direction to the outer peripheral edge of said flange. The end engaging member is made of a flat metal plate having a step with a thin outside portion and a thick base, the base being fixed on the flange. The end engaging member includes a forward end thereof slightly bent outward along the outer peripheral edge of the flange, and a defining clearance extending from the forward end of the end engaging member to the base between the end engaging member and the inside surface of the flange.

According to the seventh aspect of the invention, there is provided a metal wire winding reel characterized by at least one hole penetrating the flange for passing the metal wire therethrough.

In the first and second aspects of the invention, metal wire is taken up on a reel, and the end of the metal wire wound up full is held in the small clearance defined between the end engaging member arranged in the vicinity of the outer periphery of the inside surface of the flange and the outer peripheral edge of the flange or the flange, thereby fixing the end of the metal wire by the elasticity of the end engaging member. The wire can be easily released simply by pulling the end of the metal wire in the direction opposite to the direction of engagement with the end engaging member.

In the first aspect of the invention, the forward end of the end engaging member is slightly bent outward along the outer peripheral edge of the flange, so that the metal wire is prevented from being caught in the forward end of the end engaging member when the wire is taken up or supplied.

In the third aspect of the invention, when the metal wire is wound up full on the reel, the end of the metal wire is held between the end engaging member and the flange, thereby fixing the end of the metal wire by the pressure due to the elasticity of the end engaging member. During the wire release, the wire can be released easily simply by pulling the end of the metal wire upward with some strength.

Further, in the fourth aspect of the invention, in view of the fact that the metal elastic member providing a material of the end engaging member is a flat metal plate, the contact area and the friction force with the end of the metal wire is increased, thereby making it possible to fix the end of the metal wire more accurately. In the case where the pressure due to the elasticity of the end engaging member is small, the end of the metal wire is liable to undesirably come off from the end engaging member thereby possibly causing a problem. It is therefore necessary to increase the pressure of the end engaging member, and for this purpose, the sectional area of the metal elastic member is normally increased for an increased strength. It should be noted, however, that when the section of the elastic metal member is a circle, an increased sectional area increases the strength but reduces the elasticity. Then, a great force is required when the end of the metal wire is held between the end engaging member and the flange to the disadvantage of the work involved. According to the fourth aspect of the invention, however, this requirement can be met mainly by increasing the width of the metal elastic member when increasing the sectional area since the elastic metal member is a flat metal plate. As a result, the strength can be increased while maintaining the elasticity.

In the third to sixth aspects of the invention, an end engaging member is installed in such a manner to be fitted in the recess defined in the inside surface of the flange, and the forward end of the end engaging member is slightly bent outward along the outer peripheral edge of the flange. At the time of taking up on the reel or supplying from the reel, therefore, the metal wire is not rubbed against or caught in the end engaging member.

In the third aspect of the invention, a small clearance is defined between the forward end of the end engaging member and the outer peripheral edge of the flange, and therefore the end of the metal wire can be held easily between the end engaging member and the flange.

In the fifth and sixth aspects of the invention, a clearance is defined extending from the forward end of the end engaging member and the base between the end engaging member and the inside surface of the flange. Therefore, the end engaging member can be easily warped in the direction opposite to the direction of engagement, thereby making it possible to release the wire easily.

In the seventh aspect of the invention, the end of the metal wire is engaged with the end engaging member mounted on the inside surface of the flange and then passed through the hole penetrating the flange thereby to protrude the end of the metal wire outside of the flange. As a result, it becomes difficult for the end of the metal wire to protrude outside of the outer peripheral edge of the flange. In this case, if the end of the metal wire is fixed along the outer peripheral edge of the flange, it becomes more difficult for the end of the metal wire to protrude outside from the outer peripheral edge of the flange. The wire can be easily released simply by holding and pulling the end of the metal wire between the end engaging member and the hole penetrating the flange.

BRIEF DESCRIPTION OF THE DRAWINGS

Embodiments of the invention will be explained with reference to the accompanying drawings, wherein.

DETAILED DESCRIPTION

Figure 1:
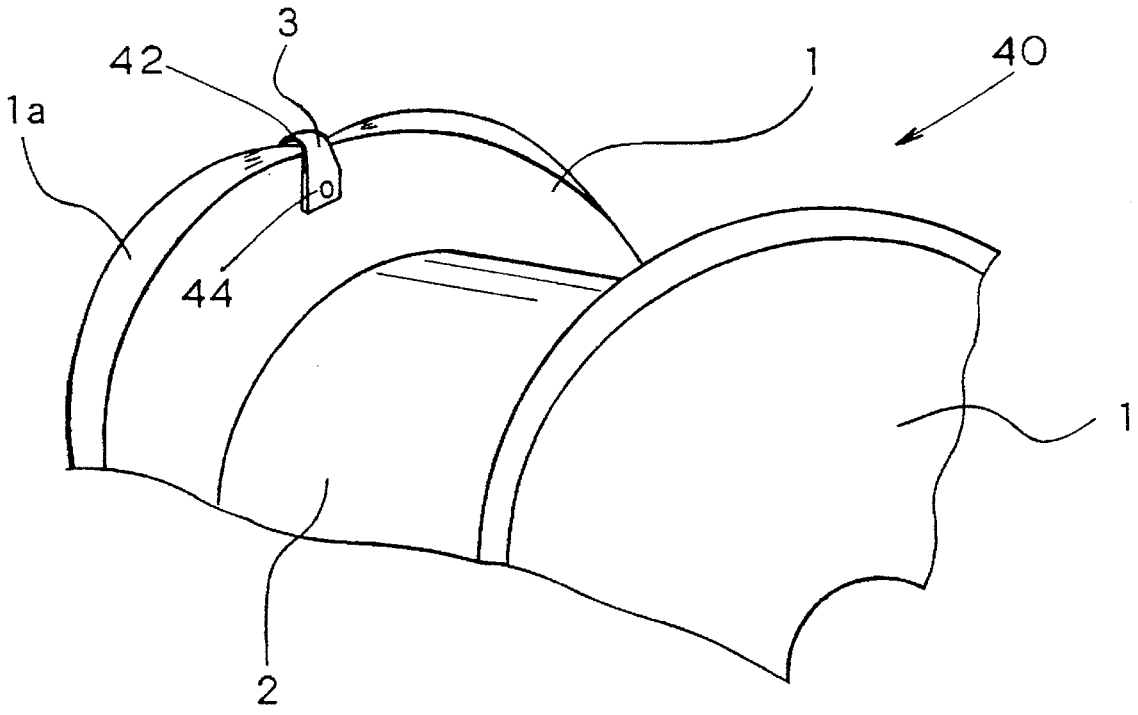
FIG. 1 is a fragmented perspective view showing the configuration of a metal wire winding reel according to the first embodiment of the invention.

As shown in FIG. 1, a metal wire winding reel 40 according to the first aspect of the invention includes a flange 1 at each end of a winding drum 2 with an end engaging member 3 mounted in the vicinity of the outer periphery of the inside surface of the flange 1.

Figure 2:
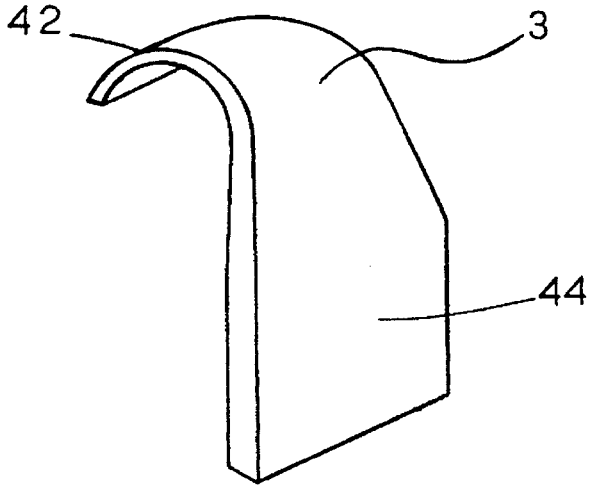
FIG. 2 is an enlarged perspective view of an end engaging member of a metal wire winding reel according to the first embodiment of the invention.

The end engaging member 3, as shown in FIG. 2, is formed of a thin elastic metal plate of about 1 mm thickness with the forward end 42 thereof bent appropriately. A small clearance is formed between the forward end 42 of the end engaging member 3 and the outer peripheral edge 1*a* of the flange, and the root 44 of the end engaging member 3 is spot-welded to the flange.

Figure 3:
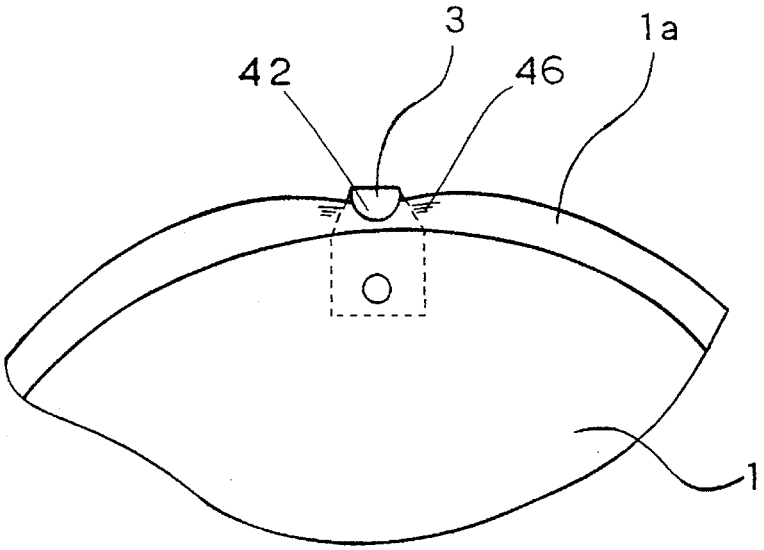
FIG. 3 is a fragmented perspective view showing a partially enlarged view of the configuration of a metal wire winding reel according to the first embodiment of the invention.

The outer peripheral edge 1*a* of the flange around the end engaging member 3, as shown in FIG. 3, is slightly recessed at 46 by being ground with a grinder. By doing so, the end engaging member 3 can be installed without being protruded from the outer peripheral edge of the flange, and therefore even when the reel is rolled, the end engaging member 3 is not damaged. Even when the outer peripheral edge 1*a* of the flange is not completely recessed to accommodate the forward end 42 as shown in FIG. 3, the operation and effects of the invention are of course not affected at all.

Figure 4:
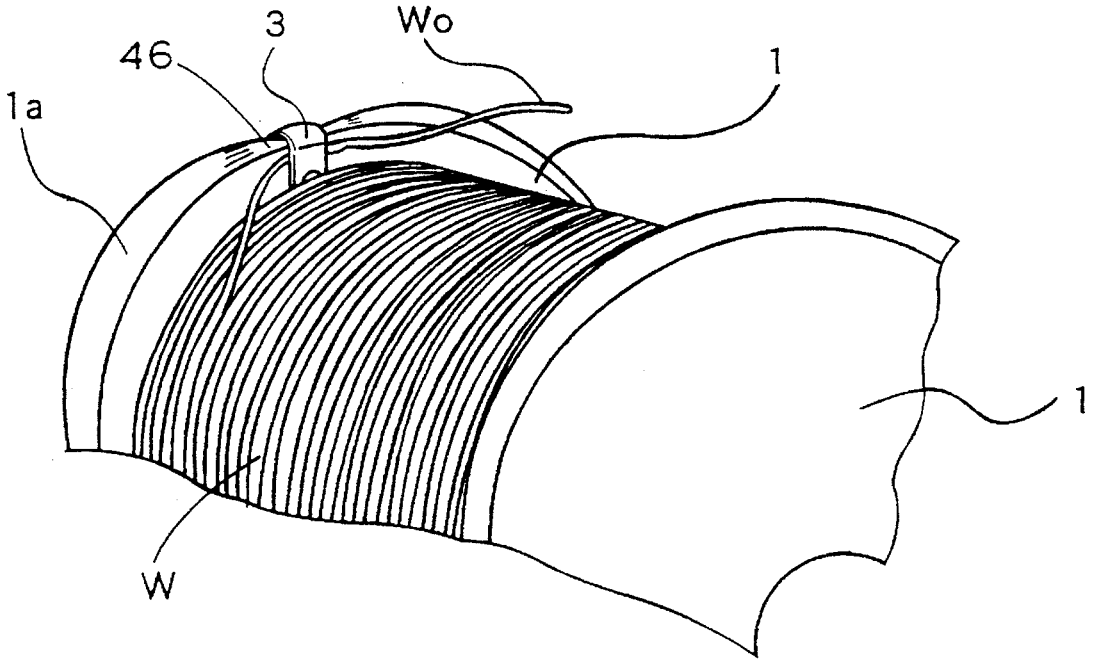
FIG. 4 is a fragmented perspective view showing the manner in which the metal wire is taken up on a metal wire winding reel according to the first embodiment of the invention.

A length of metal wire W is wound up as shown in FIG. 4 using a reel prepared as described above. The end Wo of the metal wire is inserted in the clearance between the bent forward end 42 of the end engaging member 3 and the outer peripheral edge 1*a* of the flange, and is then held by being pulled toward the center of the reel. The end Wo of the metal wire is securely held by the elasticity of the end engaging member 3.

The wire can be easily released by pulling out the end Wo of the metal wire in the direction opposite to the above-mentioned procedure.

Excessively bending the forward end 42 of the end engaging member is not preferable as the engaging and releasing operation would be exaggerated. The bending need only be to such an extent that the metal wire is not caught in the forward end of the end engaging member during engagement of the wire prior to wind up or during release of the wire.

Figure 5:
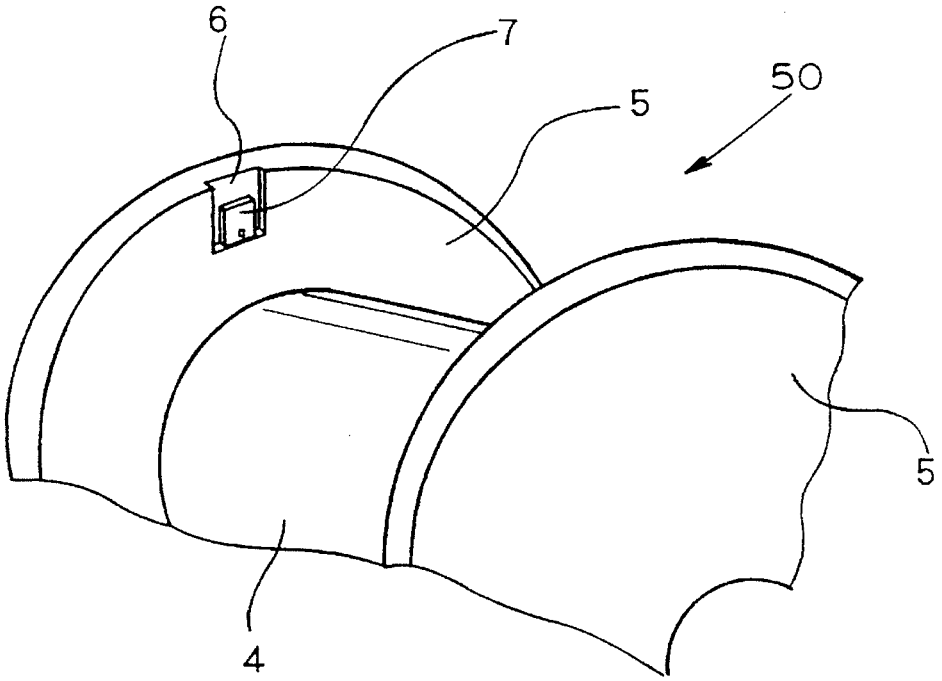
FIG. 5 is a fragmented perspective view showing the configuration of a metal wire winding reel according to the second embodiment of the invention.

As shown in FIG. 5, a metal wire winding reel 50 according to the second aspect of the invention includes a flange 5 at each end of a winding drum 4 with a recess 6 in the vicinity of the outer periphery of the inside surface of the flange and an end engaging member 7 mounted in the recess 6.

Figure 6:
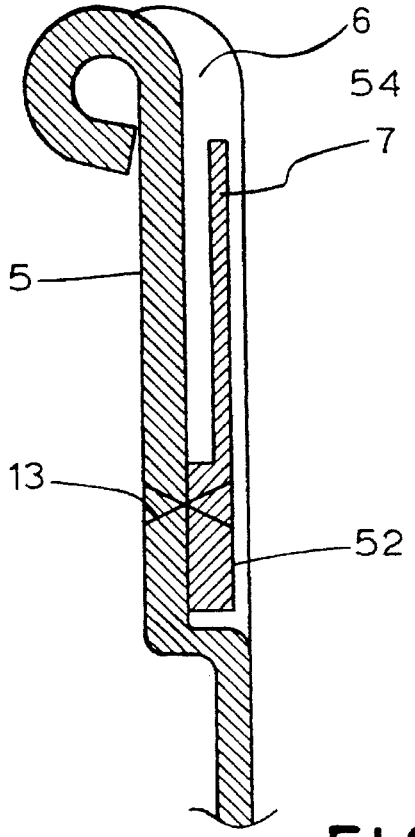
FIG. 6 is a partially enlarged, fragmented sectional view of a metal wire winding reel according to the second embodiment of the invention.

A sectional view of the flange 5 and the end engaging member 7 is shown in FIG. 6. The end engaging member 7, as shown in FIG. 6, is made of an elastic metal plate having a rather thick root 52. The root 52 of this end engaging member 7 is mounted by a spot welding 13 to the recess 6 thereby forming a small clearance 54 between the forward end of the end engaging member 7 and the flange.

A metal wire can be taken up on the reel 50 constructed in the manner described above. The end of the metal wire may be inserted in the clearance 54 between the end engaging member 7 and the flange 5, and then pulled toward the center of the reel. The end of the metal wire could thus be securely held by the elasticity of the end engaging member 7.

Also, the metal wire could be easily released by pulling the end thereof toward the outer periphery of the reel.

According to the above-mentioned embodiment, the root 52 of the end engaging member 7 is made thick to form the clearance 54 with the flange 5. In the case where a flat plate is used for the end engaging member 7, however, the forward end thereof may be bent in the direction opposite to the flange or a spacer may be fitted in the root to form a clearance for inserting the wire end.

In the first and second embodiments, an elastic metal plate was used as the material for the end engaging member. As an alternative, an elastic wire may be used. Also, the elastic plate or the elastic wire may be made uneven or corrugated with a recess in which the metal wire W is to be fitted.

Further, the metal used as the material of the end engaging member in the aforementioned embodiments may be replaced by an elastic plate of reinforced plastic or glass fiber with equal effect. Whatever material is used, however, it is required to have a strength and elasticity sufficient to stand the bend of the end engaging member which occurs when the end Wo of the metal wire is held.

Furthermore, as an alternative to the spot welding used according to the first and second embodiments as a means for mounting the end engaging member on the flange, rivets or bolts or an adhesive may be used. The appropriate one of these means can be selected taking into consideration the material of the end engaging member and the flange.

Figure 7:
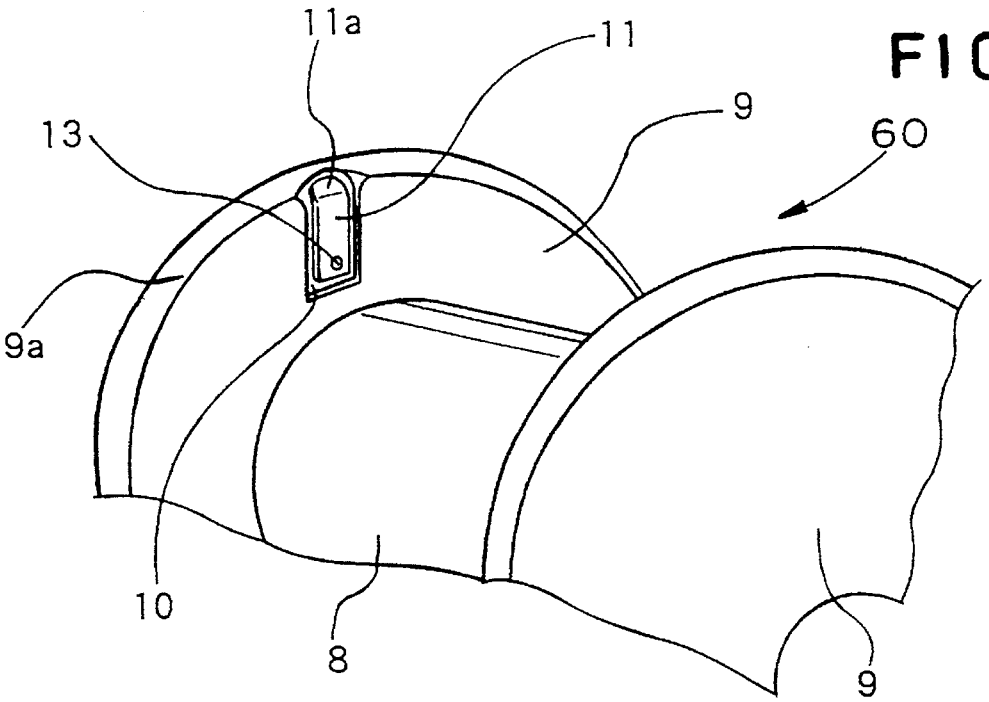
FIG. 7 is a fragmented perspective view showing the configuration of a metal wire winding reel according to the third embodiment of the invention.

As shown in FIG. 7, a metal wire winding reel 60 is constructed according to the third and fourth aspects of the invention and includes a flange 9 at each end of a winding drum 8, wherein a recess 10 extending in radial direction to the outer peripheral edge 9*a* of the flange is formed on the inside surface of the flange 9. A metal wire end engaging member 11 formed of an elastic flat metal plate is installed in such a manner as to be mounted in the recess 10.

Figure 8:
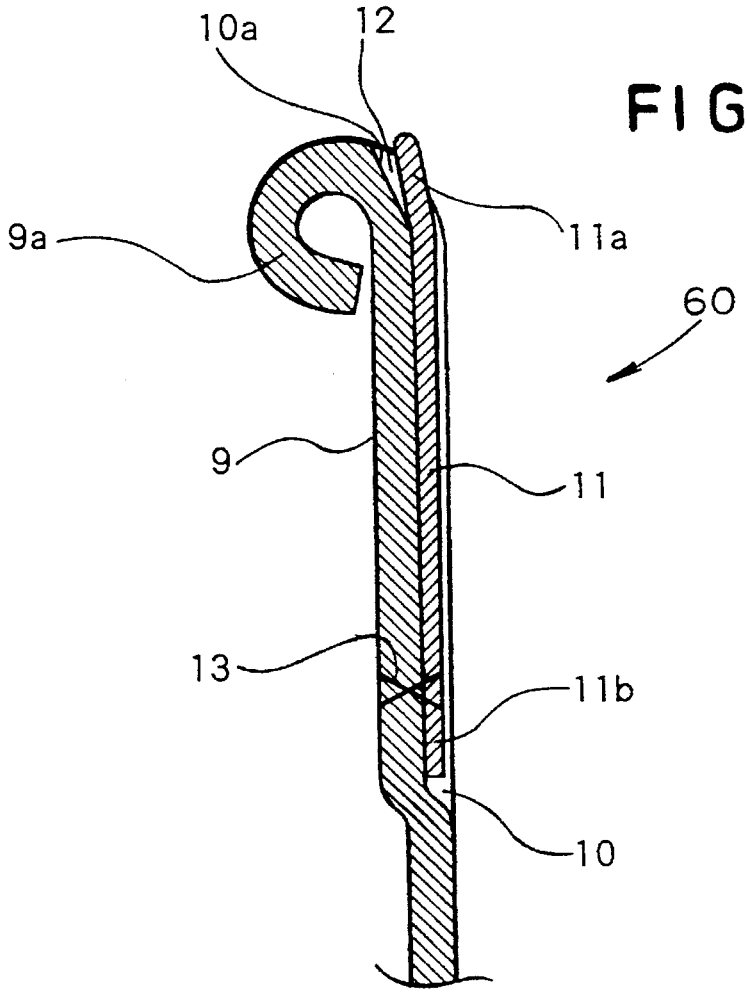
FIG. 8 is a partially enlarged, fragmented sectional view of a metal wire winding reel according to the third embodiment of the invention.

In order to explain the end engaging member 11 in detail, an enlarged sectional view thereof is shown in FIG. 8. In FIG. 8, the recess 10 is formed on the flange by press or grinding work. A sufficiently wide opening 10*a* is provided for the recess 10 in the vicinity of the outer peripheral edge 9*a* of the flange.

Also, the end engaging member 11 has a forward end 11*a* thereof slightly bent outward along the outer peripheral edge 9*a* of the flange. A small clearance 12 is formed between the forward end 11*a* and the outer peripheral edge 9*a* of the flange. The base 11*b* of the end engaging member 11 is fixed by spot welding 13 to the flange 9. This fixing means may be replaced with an adhesive.

Figure 9:
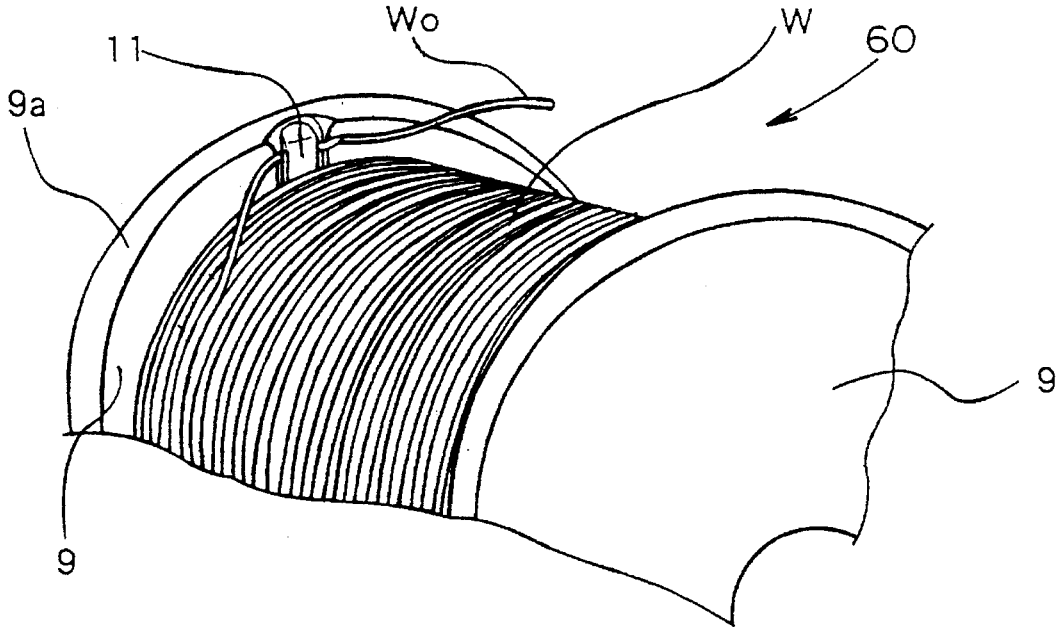
FIG. 9 is a fragmented perspective view showing the manner in which the metal wire is taken up on a metal wire winding reel according to the third embodiment of the invention.

Using a reel 60 constructed as described above, the metal wire W is taken up as shown in FIG. 9. The end Wo is introduced by way of the small clearance 12 shown in FIG. 8 and further pulled toward the center of the reel. In this way, the end Wo is held securely between the end engaging member 11 and the flange 9.

Figure 10:
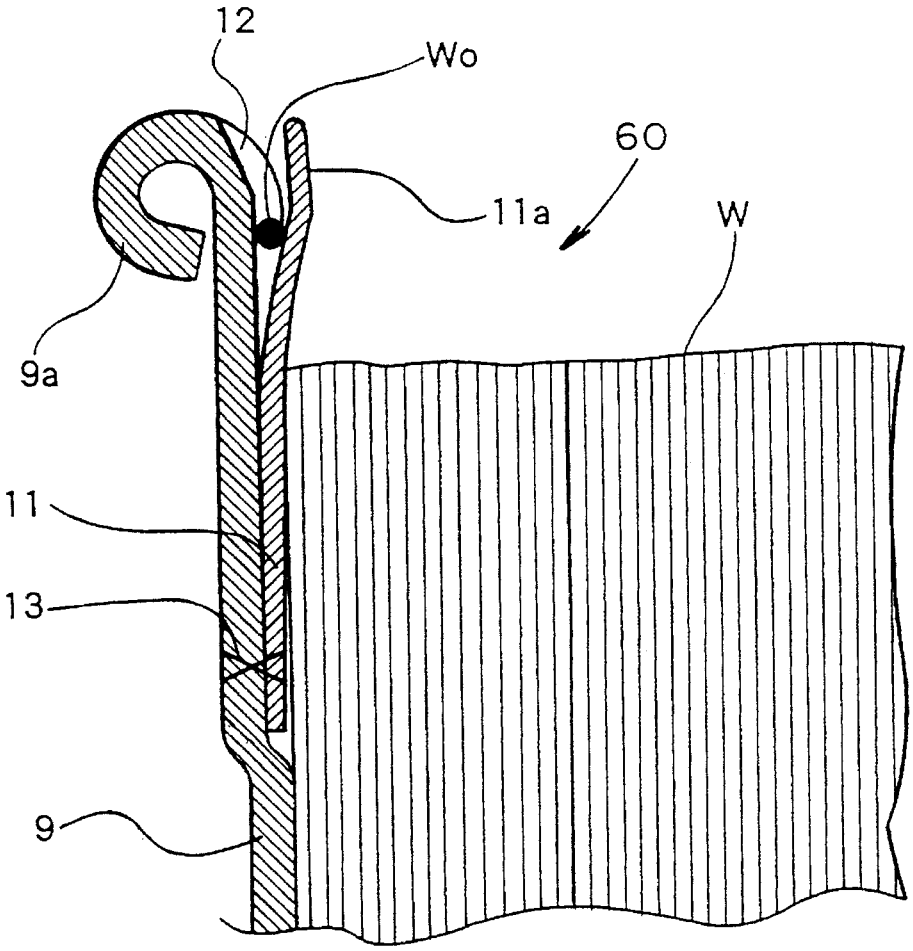
FIG. 10 is an enlarged, fragmented sectional view showing the engaged releasable mounting of the metal wire end on a metal wire winding reel according to the third embodiment of the invention.

The engaged situation of the metal wire end Wo in FIG. 9 will be explained in detail with reference to FIG. 10.

With the metal wire end Wo pulled in between the end engaging member 11 and the flange 9, the end engaging member 11 is warped in arcuate form to an extent not exceeding the elastic limit with the spot weld 13 as an origin, thereby generating a power of restitution in the direction of pressing the metal wire end Wo. Further, a static friction force is generated between the end engaging member 11 and the metal wire end Wo and also between the metal wire end Wo and the flange 9. These forces combine to hold the metal wire end Wo.

Even when the metal wire end Wo is inadvertently displaced upward, the small outward bend of the forward end 11*a* of the end engaging member functions as a bent stopper portion preventing the end Wo from undesired displacement.

The wire can be released easily simply by pulling the metal wire end Wo upward with some strength beyond the bent stopper portion. The end engaging member 11, after releasing the wire, returns to the flange side by its own elasticity and restores to the shape thereof as shown in FIG. 8.

In the case where the bending angle of the forward end 11*a* of the end engaging member 11 is excessively large, the engaging and releasing operations are undesirably exaggerated. It is sufficient if the forward end 11*a* is bent only to such an extent that the metal wire W is not caught in the forward end 11*a* of the end engaging member at the time of taking up or supplying the wire.

Figure 11:
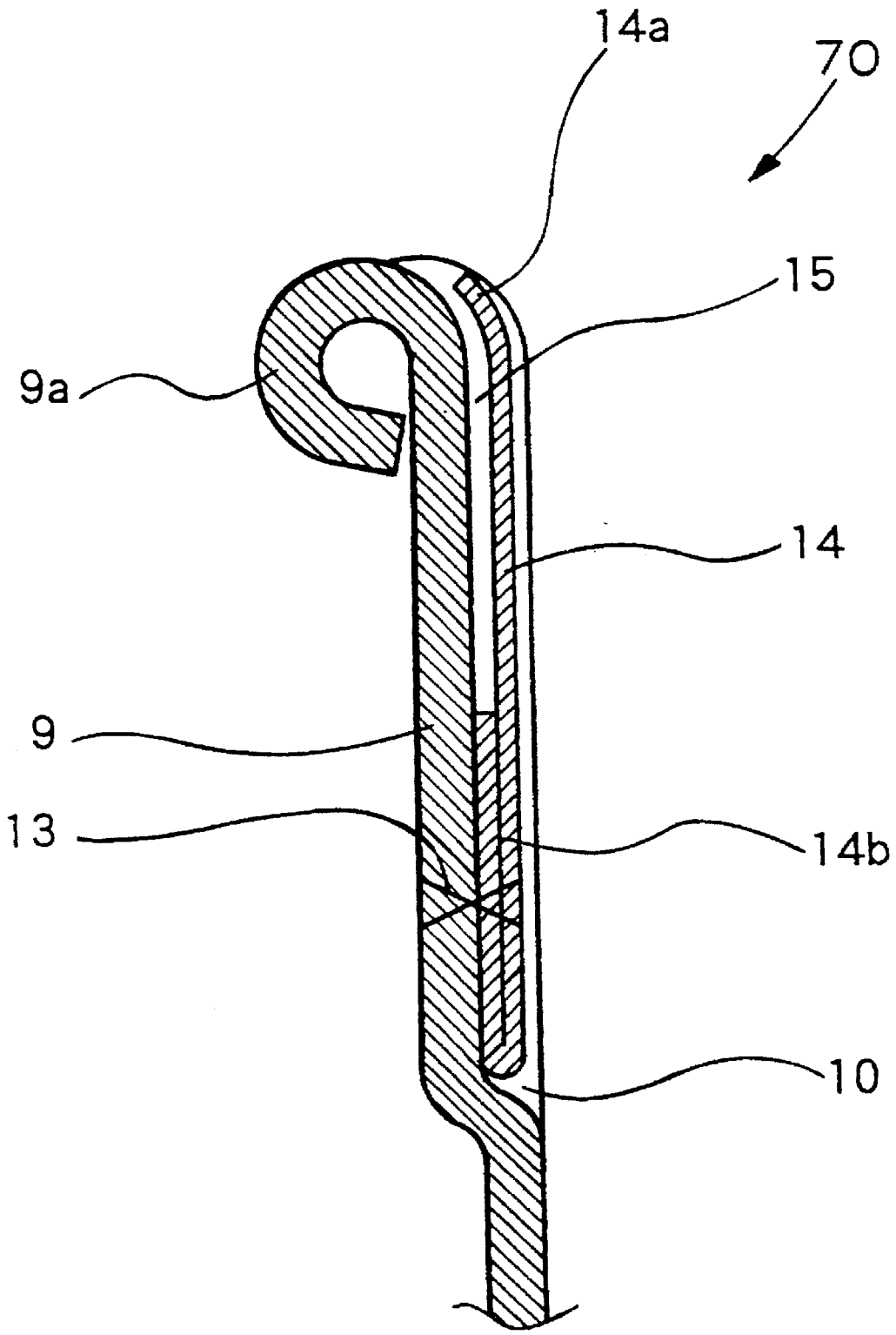
FIG. 11 is a partially enlarged, fragmented sectional view of a metal wire winding reel according to the fourth embodiment of the invention.

FIG. 11 shows a portion of a metal wire winding reel 70 according to the fifth aspect of the invention constructed so that an elastic flat metal plate 14 is partially bent to make a double metal plate with a base 14*b*, and the base 14*b* is fixed on the flange 9 by the spot weld 13. An adhesive may alternatively be used as fixing means. The forward end 14*a* of the end engaging member is slightly bent outward along the outer peripheral edge 9*a* of the flange. A clearance 15 extending from the forward end 14*a* of the end engaging member to the base 14*b* is formed between the end engaging member 14 and the inside surface of the flange 9.

Figure 12:
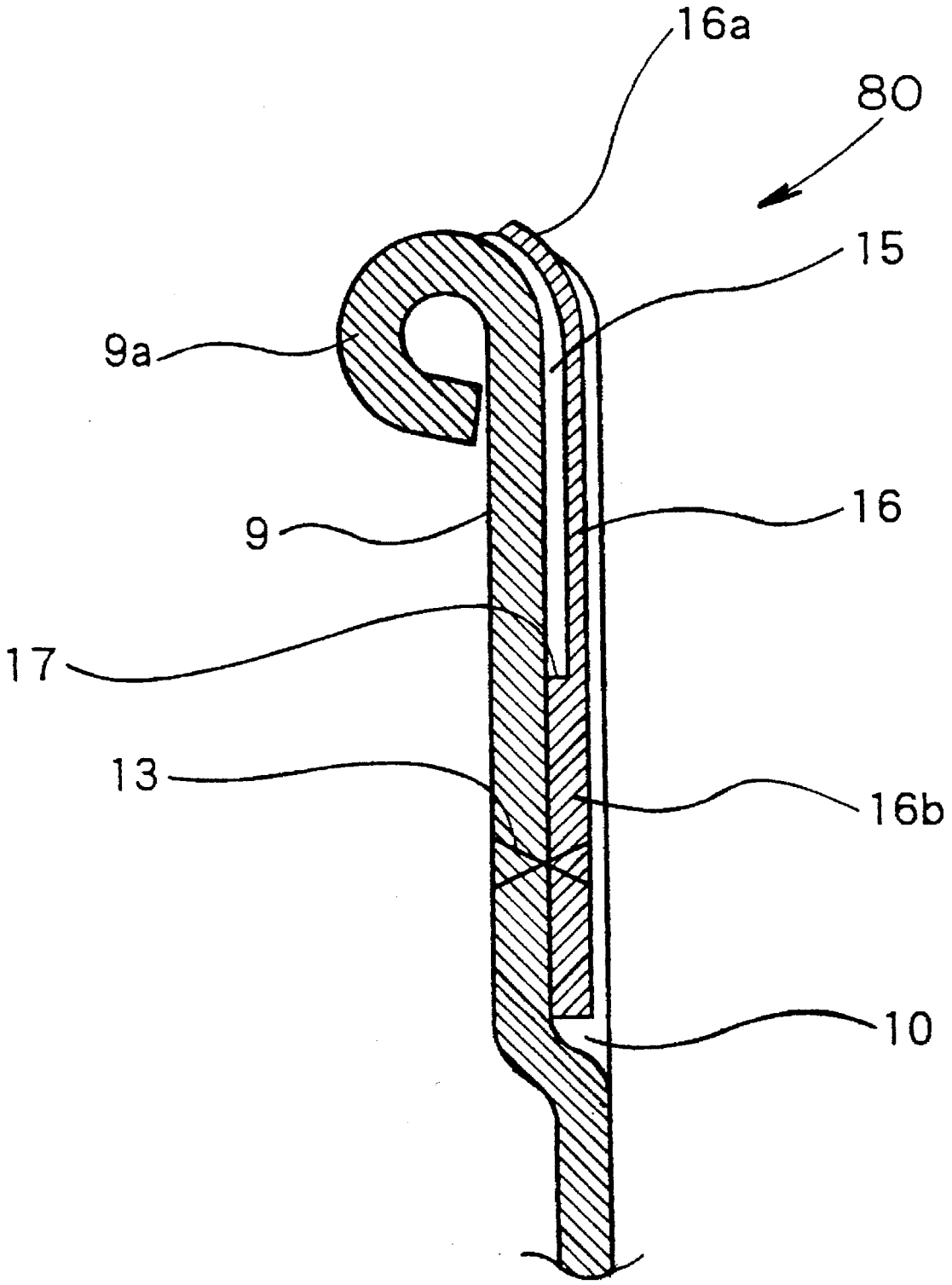
FIG. 12 is a partially enlarged, fragmented sectional view of a metal wire winding reel according to the fifth embodiment of the invention.

FIG. 12 shows a portion of a metal wire winding reel 80 according to the sixth aspect of the invention prepared in such a way that the outer thickness of an elastic flat metal plate 16 is decreased and the thickness of the base 16*b* increased by a step 17 made on the flat metal plate, and the base 16*b* is fixed on the flange 9 by the spot weld 13. An adhesive may alternatively be used as fixing means. The forward end 16*a* of the end engaging member is slightly bent outward along the outer peripheral edge 9*a* of the flange, and a clearance 15 extending from the forward end 16*a* of the end engaging member to the base 16*b* is formed between the end engaging member 16 and the inside surface of the flange 9.

As shown in FIG. 11 and FIG. 12, a clearance 15 extending from the forward end of the end engaging member to the base is formed between the end engaging member and the inside surface of the flange, and therefore the end engaging member can be easily warped in the direction opposite to the direction of engagement thereby facilitating wire release.

Also, unlike in the third, fourth and fifth embodiments using a flat metal plate as a material for the end engaging member, the embodiment under consideration can use a metal plate having an uneven or corrugated surface made by the appropriate processing in such a manner that the metal wire end is fitted in the resulting recess.

Further, in order to improve the friction force between the end engaging member and the metal wire end, the surface roughness of the end engaging member may be increased.

Figure 13:
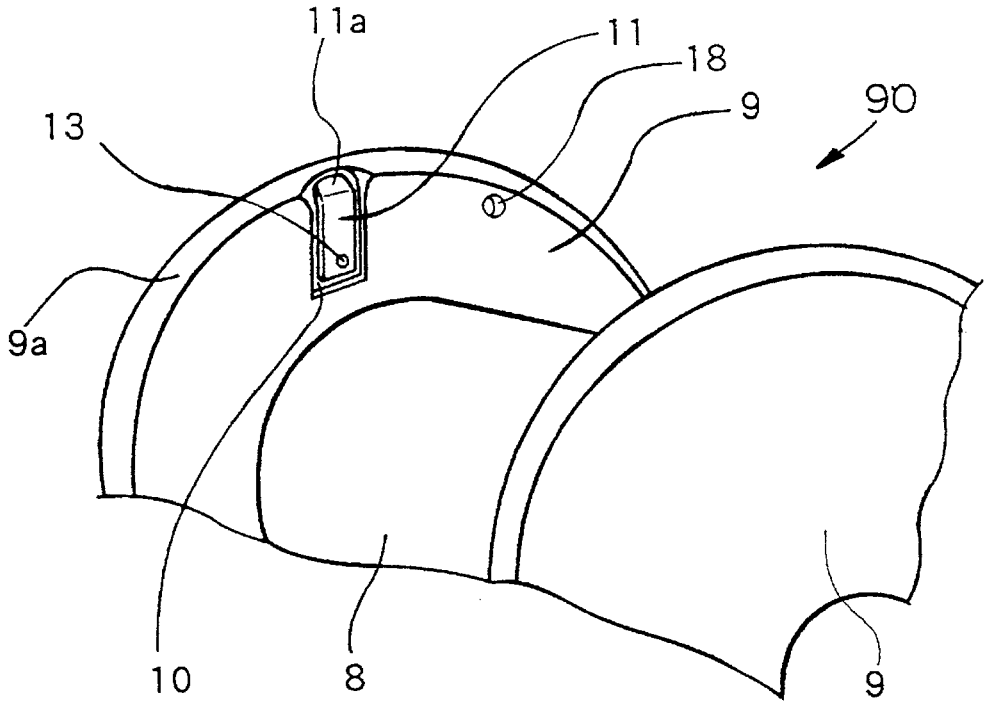
FIG. 13 is a fragmented perspective view showing the configuration of a metal wire winding reel according to the sixth embodiment of the invention.
Figure 14:
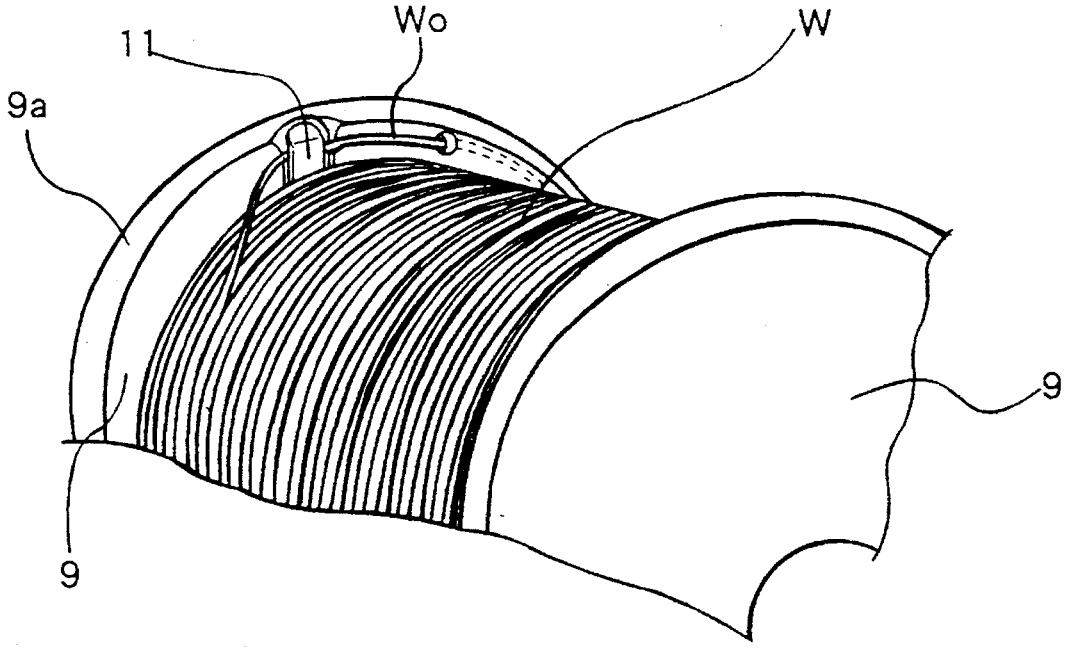
FIG. 14 is a fragmented perspective view showing the manner in which the metal wire is taken up on a metal wire winding reel according to the sixth embodiment of the invention.
Figure 15:
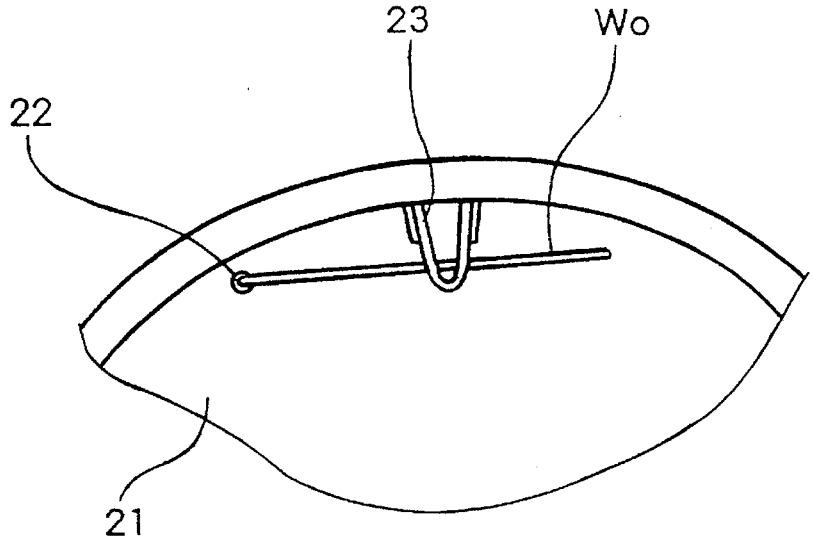
FIG. 15 (PRIOR ART)
FIG. 15 is a schematic diagram showing a conventional metal wire winding reel.
Figure 16:
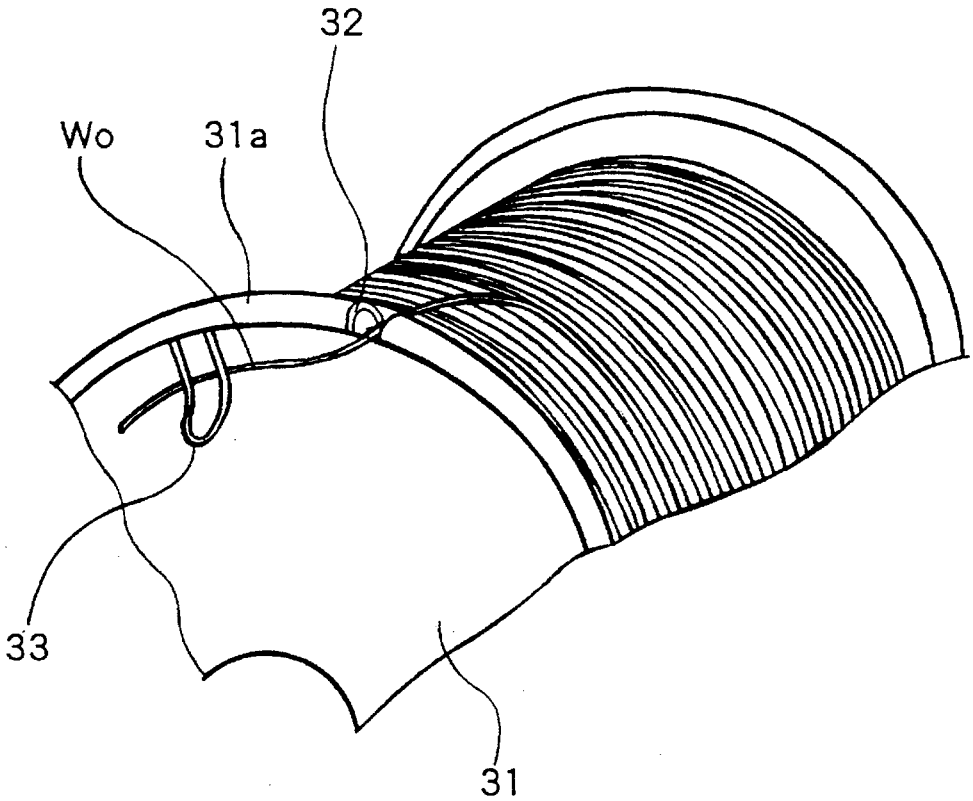
FIG. 16 (PRIOR ART)
FIG. 16 is a fragmented perspective view showing another conventional metal wire winding reel.

FIG. 13 shows a metal wire winding reel 90 according to the seventh aspect of the invention including a hole 18 penetrating the flange 9 and formed inside of the outer peripheral edge 9*a* of the flange 9. As shown in FIG. 13, the hole 18 permits the metal wire end Wo to pass through the flange through hole 18 after engagement by the end engaging member 11 and to extend onto the outside surface of the flange. As a result, it is made more difficult for the metal wire end Wo to be inadvertently displaced out of the outer peripheral edge of the flange 9.

The invention, which is constructed in the several embodiments as described above, provides the following significant advantages with one or more of the embodiments.

(1) The metal wire end need not be passed through a small hole, and therefore it is not necessary to cover the wire end with tape or fuse it down to weld strands to each other. The end engaging and releasing work is thus greatly simplified. Further, in the case where multiple unreeling jobs are performed simultaneously as in the rubber coating (calendering) process for tire manufacture, the working time is greatly reduced. Also, the need of forming a notch in the outer periphery of the flange is eliminated and the flange distortion which otherwise might occur is prevented. Thus the reel life is not shortened nor the metal wire winding deformed.

(2) The pressure holding the wire end in place can be increased while maintaining elasticity in the end engaging member.

(3) Wire release is readily provided in addition to the above-mentioned effects.

(4) The metal wire end is not displaced out of the outer peripheral edge of the flange after engagement, and therefore the packing material is not damaged by the metal wire end. Also, when a plurality of reels are stored in stacks, wire disengagement is prevented which otherwise might be caused by the metal wire end displaced into contact with the flange of other reels.

The foregoing detailed description has been given for clearness of understanding only, and no unnecessary limitations should be understood therefrom, as modifications will be obvious to those skilled in the art.

It is claimed:

1. A metal wire winding reel comprising a winding drum have a flange at each end thereof, characterized in that an elastic end engaging member is formed of a one-piece member having a forward end and a base, said base is mounted entirely within at least one recess formed in the vicinity of the outer periphery of the inside surface of said flange and said forward end defining a clearance with the flange.

2. A metal wire winding reel comprising a winding drum having a flange at each end thereof, characterized in that an end engaging member including a base and a forward end and formed of a one-piece metal elastic member is adapted to be fitted in a recess extending radially to an outer peripheral edge of the flange at least at one point on the inside surface of the flange, said forward end of said end engaging member being slightly bent outward along said outer peripheral edge of the flange, said end engaging member defining a clearance with the outer peripheral edge of said flange, and means for mounting said base of said end engaging member on said flange and entirely within said recess.

3. A metal wire winding reel according to claim 2, characterized in that said end engaging member formed of a metal elastic member is a flat metal plate.

4. A metal wire winding reel according to claims 1, 2, or 3, characterized by at least one hole penetrating the outer rim of the flange for passing the metal wire through said hole with said wire entirely surrounded by the outer rim of the flange.

5. A metal wire winding reel comprising a winding reel having a flange at each end thereof, characterized in that an end engaging member formed of a flat metal plate is adapted to be fitted in a recess formed at least at one point of the inside surface of said flange and extending in a radial direction to the outer peripheral edge of said flange, said end engaging member being made of a flat metal plate partially bent to form a base of double metal plates,said base being fixed on the flange, said end engaging member having a forward end thereof slightly bent outward along the outer peripheral edge of said flange, and a clearance extending from the forward end of said end engaging member to said base is defined between the end engaging member and the inside surface of said flange.

6. A metal wire winding reel comprising a winding drum having a flange at each end thereof, characterized in that an end engaging member of a flat metal plate is adapted to be fitted in a recess formed at least at a point on the inside surface of said flange and extending in a radial direction to the outer peripheral edge of said flange, said end engaging member being made of a flat metal plate having a step between a base portion and an outer portion so that the outer portion thereof is thinner than the base portion, said base portion being fixed on said flange, said end engaging member having the forward end of said outer portion slightly bent outward along the outer peripheral edge of said flange, and a clearance extending from the forward end of said end engaging member to the base is defined between said end engaging member and the inside surface of said flange.

7. A metal wire winding reel according to claims 5 or 6, characterized by at least one hole penetrating the flange for passing the metal wire through.

* * * * *

UNITED STATES PATENT AND TRADEMARK OFFICE

CERTIFICATE OF CORRECTION

PATENT NO. : 5,549,257

DATED : August 27, 1996

INVENTOR(S) : KENJI SANDA, ET AL.

It is certified that error appears in the above-indentified patent and that said Letters Patent is hereby corrected as shown below:

On the title page: Item

[75] Inventors:

Change "Ono, Japan" to --Ono-shi, Hyogo, Japan--.

Signed and Sealed this

Twenty-fourth Day of June, 1997

Bruce Lehman

*Attest:*

BRUCE LEHMAN

*Attesting Officer*

*Commissioner of Patents and Trademarks*